US012181229B2

(12) United States Patent
Bellis et al.

(10) Patent No.: US 12,181,229 B2
(45) Date of Patent: Dec. 31, 2024

(54) HEAT EXCHANGER WITH A GLASS BODY

(71) Applicant: Raytheon Company, Waltham, MA (US)

(72) Inventors: Lowell A. Bellis, Chino Hills, CA (US); Robert C. Hon, Walton, KY (US)

(73) Assignee: Raytheon Company, Tewksbury, MA (US)

( * ) Notice: Subject to any disclaimer, the term of this patent is extended or adjusted under 35 U.S.C. 154(b) by 989 days.

(21) Appl. No.: 16/279,153

(22) Filed: Feb. 19, 2019

(65) Prior Publication Data

US 2019/0186851 A1 Jun. 20, 2019

Related U.S. Application Data

(63) Continuation of application No. 16/019,200, filed on Jun. 26, 2018, now Pat. No. 10,429,139, which is a (Continued)

(51) Int. Cl.

| | |
|---|---|
| ***F28F 21/00*** | (2006.01) |
| ***F25B 9/14*** | (2006.01) |
| ***F28F 7/02*** | (2006.01) |

(52) U.S. Cl.

CPC ..... *F28F 21/006* (2013.01); *F28F 7/02* (2013.01); *F25B 9/145* (2013.01); *F25B 2309/1406* (2013.01); *F25B 2309/1415* (2013.01)

(58) Field of Classification Search

CPC ..... F25B 9/145; F25B 2309/1415; F25B 2309/1406; F28F 21/006; F28F 7/02

See application file for complete search history.

(56) References Cited

U.S. PATENT DOCUMENTS 2,235,291 A * 3/1941 Gaertner ..... B28B 3/20 264/150

2,752,731 A 7/1956 Altosaar (Continued)

FOREIGN PATENT DOCUMENTS

DE 3043996 A1 * 6/1981

DE 102004011354 A1 * 9/2005 ..... F28F 1/40

(Continued)

OTHER PUBLICATIONS

Ashman et al., "A Review of Mfg. Processes for Microchannel Heat Exchanger Fabrication," Proceedings of ICNMM2006 4th Int'l Conf. of Nanochannels, Microchannels and Minichannels, Limerick, Ir., pp. 1-6, Jun. 19-21, 2006.

(Continued)

*Primary Examiner* — Ljiljana V. Ciric

(57) ABSTRACT

An apparatus includes a glass body having a first face and a second face on opposing ends and defining a longitudinal axis between the opposing ends. The glass body includes multiple planar exterior surfaces, each extending continuously from the first face to the second face. The glass body also includes an interior surface surrounding an aperture, the aperture extending longitudinally from the first face to the second face. The glass body further includes a plurality of holes surrounding the aperture, where the holes are disposed within the glass body and extend longitudinally from the first face to the second face. The holes are configured to receive and direct a gas through the holes to exchange heat between the gas and the glass body.

20 Claims, 5 Drawing Sheets

Related U.S. Application Data continuation of application No. 12/888,306, filed on Sep. 22, 2010, now Pat. No. 10,041,747.

(56) References Cited

U.S. PATENT DOCUMENTS 2,887,304 A 5/1959 Hilliard
2,977,265 A 3/1961 Forsberg et al.
3,251,403 A 5/1966 Smith et al.
3,262,251 A 7/1966 Hicks, Jr.
3,380,817 A 4/1968 Gardner et al.
3,518,069 A 6/1970 Cole, Jr.
3,607,185 A 9/1971 Andrysiak et al.
3,653,739 A 4/1972 Strack et al.
3,660,784 A 5/1972 Scharfman et al.
3,678,992 A 7/1972 Daniels et al.
3,692,095 A 9/1972 Fleming et al.
3,692,099 A 9/1972 Nesbitt et al.
3,693,711 A 9/1972 Zygiel et al.
3,713,202 A 1/1973 Roberts et al.
3,732,919 A 5/1973 Wilson
3,771,592 A 11/1973 Sayers
3,837,830 A 9/1974 Eberhart
3,854,523 A 12/1974 Smith et al.
3,871,852 A * 3/1975 Pei ..... F16L 9/10 65/DIG. 9
3,885,942 A * 5/1975 Moore ..... F28D 19/042 165/8
3,923,940 A * 12/1975 Hujii ..... B29D 99/0089 428/116
3,926,251 A * 12/1975 Pei ..... C03B 23/207 165/DIG. 449
3,933,195 A 1/1976 St. Clair
3,936,288 A 2/1976 Pei
3,940,301 A * 2/1976 Straw ..... C04B 35/593 156/89.27
3,948,317 A * 4/1976 Moore ..... F28D 19/042 165/DIG. 396
3,951,175 A 4/1976 Eberhart
3,959,865 A 6/1976 Close et al.
3,968,786 A 7/1976 Spielberg
3,976,463 A 8/1976 Pei
3,989,096 A 11/1976 Allardyce et al.
4,020,896 A 5/1977 Mold et al.
4,034,805 A 7/1977 Mold et al.
4,041,591 A * 8/1977 Noll ..... F28F 7/02 428/117
4,041,592 A * 8/1977 Kelm ..... F28F 21/04 428/117
4,045,199 A 8/1977 Mold et al.
4,049,049 A 9/1977 Mold et al.
4,049,050 A 9/1977 Mold et al.
4,051,891 A 10/1977 Harrison
4,066,120 A 1/1978 Mold et al.
4,076,513 A 2/1978 Pei
4,083,400 A 4/1978 Dziedzic et al.
4,101,287 A * 7/1978 Sweed ..... F28F 7/02 165/165
4,120,352 A 10/1978 Husson
4,126,178 A 11/1978 Kelm
4,127,398 A 11/1978 Singer, Jr.
4,130,160 A 12/1978 Dziedzic et al.
4,149,591 A * 4/1979 Albertsen ..... F28F 7/02 165/DIG. 395
4,157,929 A 6/1979 Kubicek
4,202,660 A * 5/1980 Pei ..... C03B 23/207 431/355
4,209,059 A 6/1980 Anthony et al.
4,213,929 A 7/1980 Dobson
4,222,434 A 9/1980 Clyde
4,224,982 A 9/1980 Frei
4,271,110 A * 6/1981 Minjolle ..... F28F 21/04 264/209.1
4,276,071 A * 6/1981 Outland ..... F01N 3/0222 428/116
4,283,210 A * 8/1981 Mochida ..... B01D 29/52 428/116
4,293,357 A * 10/1981 Higuchi ..... B01D 29/52 428/116
4,295,522 A 10/1981 Frei
4,298,059 A * 11/1981 Krauth ..... F28D 9/0068 165/DIG. 395
4,340,403 A * 7/1982 Higuchi ..... B01D 46/2407 428/117
4,359,872 A 11/1982 Goldowsky
4,364,760 A * 12/1982 Higuchi ..... B01D 29/111 501/153
4,389,089 A 6/1983 Strack
4,421,702 A * 12/1983 Oda ..... F28F 21/04 428/116
4,446,024 A 5/1984 Baker et al.
4,488,864 A 12/1984 Borrelli et al.
4,513,814 A 4/1985 Wallstein
4,533,584 A * 8/1985 Takeuchi ..... B01D 46/4218 428/116
4,545,429 A 10/1985 Place, Jr. et al.
4,546,827 A 10/1985 Wachendorfer, Sr.
4,582,126 A 4/1986 Corey
4,596,628 A 6/1986 Betz
4,601,332 A * 7/1986 Oda ..... F28F 21/04 165/DIG. 395
4,604,869 A * 8/1986 Yoshida ..... F01N 3/0222 428/116
4,619,112 A 10/1986 Colgate
4,642,210 A 2/1987 Ogawa et al.
4,645,700 A * 2/1987 Matsuhisa ..... B28B 3/269 428/116
4,653,575 A 3/1987 Courchesne
4,658,887 A 4/1987 Matsuhisa et al.
4,689,255 A 8/1987 Smoot et al.
4,711,298 A * 12/1987 Rogier ..... F28F 21/04 165/DIG. 395
4,732,593 A * 3/1988 Kondo ..... F01N 3/0222 60/311
4,746,479 A * 5/1988 Hanaki ..... F28F 7/02 264/150
4,768,586 A 9/1988 Berneburg et al.
4,770,828 A * 9/1988 Rogier ..... F28F 21/04 264/317
4,787,443 A 11/1988 Fukatsu et al.
RE33,013 E * 8/1989 Takeuchi ..... B01J 15/00 428/116
4,852,645 A 8/1989 Coulon et al.
4,853,020 A 8/1989 Sink
4,911,227 A 3/1990 Saito et al.
5,062,911 A * 11/1991 Hampton ..... B01D 29/111 156/89.17
5,092,155 A 3/1992 Rounbehler et al.
5,101,894 A 4/1992 Hendricks
5,152,147 A 10/1992 Saho et al.
5,213,153 A 5/1993 Itoh
5,234,594 A 8/1993 Tonucci et al.
5,264,722 A 11/1993 Tonucci et al.
5,298,329 A 3/1994 Boatner et al.
5,298,337 A 3/1994 Hendricks
5,322,116 A * 6/1994 Galloway ..... F28F 13/003 110/302
5,373,634 A * 12/1994 Lipp ..... F28F 21/04 165/185
5,416,057 A * 5/1995 Lipp ..... F01N 3/2889 427/230
5,575,067 A 11/1996 Custer et al.
5,725,051 A * 3/1998 Veltkamp ..... F28F 21/06 165/165
5,749,232 A 5/1998 Sauer
5,879,425 A 3/1999 Jensen
5,888,613 A * 3/1999 Ketcham ..... B29C 48/13 428/116
5,901,783 A 5/1999 Dobak, III et al.
5,941,302 A * 8/1999 Hattori ..... C04B 35/584 165/905
6,090,426 A 7/2000 Vincent

(56) References Cited

U.S. PATENT DOCUMENTS 6,174,352 B1 1/2001 Semerdjian et al.
6,174,490 B1 * 1/2001 Brinkman ..... F28F 9/162 264/630
6,347,453 B1 2/2002 Mitchell
6,397,942 B1 6/2002 Ito et al.
6,467,312 B1 10/2002 De Hazan et al.
6,479,129 B1 11/2002 Kar et al.
6,491,578 B2 12/2002 Yoshinori et al.
6,526,750 B2 3/2003 Bliesner et al.
6,574,968 B1 * 6/2003 Symko ..... F25B 9/145 60/520
6,594,429 B1 7/2003 White
6,675,880 B2 1/2004 Namba et al.
6,712,131 B1 * 3/2004 Brinkman ..... B01D 63/0221 165/905
6,804,967 B2 * 10/2004 Symko ..... F25B 9/145 60/520
6,892,802 B2 5/2005 Kelly et al.
6,985,660 B2 1/2006 Koshiba et al.
7,082,242 B2 7/2006 Fajardo et al.
7,137,413 B2 11/2006 Bauer et al.
7,137,445 B2 11/2006 Kushner et al.
7,166,212 B2 1/2007 Belov et al.
7,168,481 B2 1/2007 Ishiyama et al.
7,285,153 B2 * 10/2007 Bruun ..... F28F 7/02 165/DIG. 395
7,294,316 B2 * 11/2007 Harada ..... C04B 35/10 428/116
7,331,381 B2 2/2008 Wang et al.
7,367,968 B2 5/2008 Rosenberg et al.
7,380,587 B2 6/2008 Naruse et al.
7,578,174 B2 8/2009 Hofmann
7,638,182 B2 12/2009 D'urso et al.
7,707,854 B2 5/2010 D'Urso
7,767,564 B2 8/2010 Dutta
7,913,746 B2 3/2011 Hirooka et al.
7,981,168 B2 7/2011 Ishiyama et al.
7,981,375 B2 * 7/2011 Ramberg ..... F02D 41/1406 264/630
8,041,170 B2 10/2011 Taru
8,092,753 B2 * 1/2012 Ramberg ..... B01J 8/02 422/129
8,197,769 B2 6/2012 Caze et al.
8,211,376 B2 7/2012 Caze et al.
8,211,377 B2 7/2012 Caze et al.
8,221,694 B2 * 7/2012 Ramberg ..... B01D 46/80 422/139
8,245,543 B2 8/2012 Huenermann
8,277,743 B1 * 10/2012 Ramberg ..... F01N 3/28 422/600
8,330,113 B2 12/2012 Kawaguchi et al.
8,359,829 B1 * 1/2013 Ramberg ..... F02D 41/1453 60/285
8,361,406 B2 * 1/2013 Ramberg ..... B01J 8/009 422/216
8,361,420 B2 * 1/2013 Ramberg ..... B01D 46/80 422/129
8,381,548 B2 2/2013 Takenaga
8,383,872 B2 2/2013 Tonkovich et al.
8,397,796 B2 3/2013 Thayer et al.
8,475,729 B2 7/2013 Sutherland
8,551,216 B2 * 10/2013 Ramberg ..... B01J 20/28042 95/134
8,623,287 B2 * 1/2014 Ramberg ..... B01J 8/009 423/210
8,679,418 B2 * 3/2014 Ramberg ..... F01N 3/28 422/600
8,821,803 B2 * 9/2014 Ramberg ..... B01J 20/2803 422/177
8,980,093 B2 3/2015 Belov et al.
9,086,231 B2 7/2015 Xu et al.
9,308,510 B2 4/2016 Hazeltine
9,406,535 B2 8/2016 Berry, III et al.
9,457,436 B2 10/2016 Koizumi
9,511,345 B1 * 12/2016 Ramberg ..... F01N 3/0222
9,759,157 B2 * 9/2017 Miyairi ..... F03G 7/002
9,765,760 B2 * 9/2017 Miyairi ..... F03G 7/00
10,105,695 B2 10/2018 Boulet et al.
10,113,810 B2 10/2018 Parkinson et al.
10,234,209 B2 * 3/2019 Tokuda ..... F28D 7/0066
10,393,446 B2 * 8/2019 Wagner ..... B33Y 80/00
10,415,901 B2 * 9/2019 Ranjan ..... F28F 21/04
10,619,938 B2 * 4/2020 Kawaguchi ..... F28F 21/04
11,079,186 B2 * 8/2021 Walter ..... F28F 7/02
11,333,447 B2 * 5/2022 Yun ..... F28F 3/025
11,353,267 B2 * 6/2022 Fumoto ..... F28F 7/02
11,397,052 B2 * 7/2022 Fumoto ..... F01N 13/009
11,725,881 B2 * 8/2023 Felton ..... C04B 35/111 165/164
2002/0125001 A1 9/2002 Kelly et al.
2003/0221734 A1 12/2003 Bauer et al.
2004/0000150 A1 * 1/2004 Symko ..... F25B 9/145 62/6
2004/0261379 A1 12/2004 Bruun et al.
2005/0056410 A1 3/2005 Ishiyama et al.
2005/0211418 A1 9/2005 Kenny et al.
2005/0241815 A1 11/2005 Caze et al.
2006/0024478 A1 2/2006 D'Urso et al.
2007/0107888 A1 5/2007 Ishiyama et al.
2008/0223080 A1 9/2008 D'Urso
2009/0025919 A1 1/2009 Ishiyama et al.
2009/0056924 A1 3/2009 Inatomi et al.
2009/0169445 A1 7/2009 Caze et al.
2010/0132928 A1 6/2010 Sutherland
2010/0143215 A1 6/2010 Caze et al.
2010/0326532 A1 12/2010 Caze et al.
2016/0084198 A1 * 3/2016 Miyairi ..... F02G 1/02 60/516
2016/0084238 A1 * 3/2016 Miyairi ..... F02G 1/0435 60/530
2016/0333757 A1 * 11/2016 Miyairi ..... F02B 47/02
2018/0266770 A1 * 9/2018 Wagner ..... F28D 7/0025

FOREIGN PATENT DOCUMENTS

DE 102008028728 A1 12/2009
DE 202016106860 U1 * 4/2018 ..... F25B 9/14
EP 37236 A * 10/1981 ..... F28F 21/04
EP 131502 A * 1/1985 ..... F28F 21/04
EP 140601 A * 5/1985 ..... B28B 3/269
EP 433582 A * 6/1991 ..... B01D 29/111
EP 750971 A2 * 1/1997 ..... B28B 3/26
EP 0860667 A1 8/1998
EP 941759 A1 * 9/1999 ..... B01D 53/22
EP 1533585 A2 * 5/2005 ..... F28D 7/0008
EP 1533585 B1 * 1/2008 ..... F28D 7/0008
EP 3293478 A1 * 3/2018 ..... B32B 3/266
FR 2630023 A1 * 10/1989
GB 1070078 5/1967
GB 1566029 A * 4/1980 ..... B01D 63/066
GB 2031571 A * 4/1980 ..... F28D 19/042
GB 1583052 A * 1/1981 ..... F28D 9/0062
GB 2064361 A * 6/1981 ..... B01D 46/247
JP 60141541 A * 7/1985 ..... B28B 3/269
JP 60255126 A * 12/1985 ..... B01J 35/04
JP 2004525759 A * 8/2004
NO 321805 B1 * 7/2006 ..... F23C 13/00
WO WO-2004014530 A1 * 2/2004 ..... B01D 53/22
WO WO-2005085737 A1 * 9/2005 ..... F28F 1/40
WO 2010/002362 A1 1/2010

OTHER PUBLICATIONS

Kotsubo et al., "Superfluid Stirling-Cycle Refrigeration Below 1 Kelvin," Condensed Matter and Thermal Physics Group, Los Alamos Nat'l Lab., Los Alamos, NM, Journal of Low Temperature Physics, vol. 83, Nos. 3/4, p. 217, Jan. 23, 1991.

(56) References Cited

OTHER PUBLICATIONS

Watanabe et al., "Measurements with a Recuperative Superfluid Stirling Refrigerator" Condensed Matter and Thermal Physics Group, Los Alamos Nat'l Lab., Los Alamos, NM, Advances in Cryogenic Eng'g, vol. 41, pp. 1527-1529, 1996.
Zhu et al., "A Perforated Plate Stacked SI/Glass Heat Exchanger with In-Situ Temperature Sensing for Joule-Thomson Coolers," 21th IEEE Int'l Conf. on Micro Electro Mech. Sys., pp. 844-847, Jan. 13-17, 2008.
European Search Report dated Apr. 11, 2014 in connection with European Patent Application No. 11174727.5, 7 pages.
European Examination Report issued for European Patent Application No. 11174727.5 dated Mar. 10, 2016, 5 pages.
European Examination Report dated Feb. 1, 2017 in connection with European Patent Application No. 11174727.5, 4 pages.
Communication Pursuant to Article 94(3) EPC in European Patent Application No. 11174727.5 dated Mar. 16, 2018, 4 pages.

* cited by examiner

HEAT EXCHANGER WITH A GLASS BODY

RELATED APPLICATIONS AND CLAIM OF PRIORITY

This application is a continuation of U.S. patent application Ser. No. 16/019,200 filed on Jun. 26, 2018, which is a continuation of U.S. patent application Ser. No. 12/888,306 filed on Sep. 22, 2010 (now U.S. Pat. No. 10,041,747).

BACKGROUND

This disclosure relates generally to heat exchangers. More particularly, this disclosure relates to improved structures and geometries for glass heat exchangers, which are more efficient in gas heat exchange.

Heat exchangers are devices that facilitate the transfer of heat between mediums. Such devices are found in a large number of applications, ranging from air-conditioning units, to engines, and so on. In some heat exchangers, efficiency is determined by the effectiveness of the heat exchanger in thermally isolating opposing sides of the heat exchanger such that a gas or other working fluid flowing therebetween transfers heat to the heat exchanger between a hot end and a cold end of the heat exchanger. One particular application of a heat exchanger where such an efficient heat gradient is of particular importance is in a cryogenic cooler ("cryocooler"), which may utilize the cold end to effectively cool various components, such as electronics, superconducting magnets, optical systems, or so on.

The primary use of the heat exchanger in systems such as cryocoolers may be to pre-cool the working gas as it is transferred from the hot end to the cold end of the machine. Such heat exchangers may be characterized by how the gas flows through the exchanger and the surrounding system. For example, many closed cycle, linear cryocooler systems utilize the Stirling cycle, wherein a working gas cyclically flows in opposing directions through the heat exchanger. Such systems are typically referred to as regenerative heat exchangers, or regenerators. In other systems, a working gas steadily flows through the heat exchanger, utilizing processes such as the Joule-Thompson effect to create the cold end. The heat exchangers of these steady flow systems are typically referred to as recuperative heat exchangers, or recuperators.

The effectiveness of heat exchangers may be dependent upon various factors, such as heat transfer effectiveness, pressure drop, heat capacity, and parasitic conduction of heat. In regenerative systems, the gas is compressed at the hot end of the regenerator, and will be allowed to expand after it reaches the cold end. The structure of the heat exchanger itself may prevent the transfer of significant amounts of heat to the cold end as it flows. In regenerative systems, the oscillating rate of gas flow is typically of a high frequency. Therefore, the rate of heat transfer from the working gas to the regenerator should be rapid to ensure a desirable amount of pre-cooling of the gas through the heat exchanger.

Minimizing pressure drop across the heat exchanger is also desirable in increasing cooler efficiency, however this is typically at odds with maximizing the rate of heat transfer because obtaining maximum heat transfer effectiveness is generally through maximizing the mount of solid surface area over or around which the gas flows, which may create flow friction for the gas, and thus increase the pressure drop. In many heat exchangers, the cross-sectional flow area and parameters of porosity for the heat exchanger are varied to balance minimal pressure drop and maximum heat transfer.

The heat capacity of the heat exchanger must be such that the exchanger may absorb heat from the working gas without experiencing an intrinsic temperature increase which may reduce system efficiency. An interplay between the specific heat of the heat exchanger materials and the specific heat of the working gas exists, and may be particularly troublesome when cryogenic temperatures are sought to be achieved at the cold end of the exchanger. As one example, the specific heat of helium (a common working gas) is relatively high at cryogenic temperatures, while the specific heat of common heat exchanger materials is lower at cryogenic temperatures than at room temperature. This may call for an increased volume or mass for the heat exchanger.

The material selection for the heat exchanger is also important in preventing parasitic conduction of heat, for example along the axis of the heat exchanger. Where a large temperature gradient occurs along the length of the heat exchanger, it is very desirable that the exchanger have low thermal conductivity along its length, as high conductivity may result in heat being conducted from the hot end to the cold end. This conducted heat is a parasitic reduction of efficiency, because it must be carried as part of the refrigeration that is produced by the cycle.

One type of conventional heat exchanger typically contains a large number of woven-wire screens (i.e. on the order of 1000 screens in some embodiments) that are packed together into a volume. The working gas flows through the screens of the volume, so that the screens, which are typically formed from stainless steel, absorb the heat from the gas. The screen material may be similar to that of typical filter screens, with hundreds of wires per inch of material and wire diameters on the scale of a thousandth of an inch. The wires are generally drawn from stainless steel stock, a material that exhibits acceptable heat capacity and thermal conductivity.

There are limitations to stacked screen heat exchangers, however. For example, the heat capacity of the stainless material drops to unacceptably low levels at low cryogenic temperatures (i.e. below 30K). Additionally, construction limitations on the screens permit only a relatively small range of regenerator porosities, the ratio of regenerator open volume to overall regenerator volume (typically 60-75%). Similarly, the pore size between rows of wire is limited. Restrictions on achievable porosity and pore size limit the ability of a cryocooler designer to effectively optimize the relationship between pressure drop, heat transfer effectiveness and heat capacity. As an example, at very low temperatures, such as those encountered in the $2^{nd}$ stage of a multi-stage cryocooler, the ideal screen regenerator might have a porosity significantly lower than 60% such that the solid volume (and hence heat capacity) is increased in order to combat the reduction in specific heat of the stainless steel at such low temperatures. However, porosities significantly below 60% are difficult to obtain using stainless steel screen technology.

Another type of conventional heat exchangers contains packed sphere beds. The working glass flows through the spaces between the spheres of the exchanger, transferring heat into the spheres as it moves through the heat exchanger. The sphere bed heat exchangers have an advantage of being able to utilize materials that may not easily be formed into woven screens, such as lead or rare-earth metals, that may exhibit high specific heats at low cryogenic temperatures. Sphere bed heat exchangers also have an additional benefit of permitting a lower porosity for the heat exchanger (i.e. below 40% for some embodiments), which can be achieved due to the inherent geometry of the sphere pack. The lower porosity allows more solid material, and thus greater heat capacity, while maintaining an acceptable tolerance of pressure drop for many applications. In some cryocoolers utilizing packed spheres, temperatures as low as 11K at the cold end have been achieved. Despite this success, sphere beds are less effective at higher temperatures, where heat capacity is less of a concern than pressure drop.

A more recent development in heat exchanger technology has been the use of glass as the heat exchanging element. Glass manufacturing processes include etching, grinding, or machining, which may permit, among other things, greater degrees of shaping and control of the porosity of the heat exchanger. The present manufacturing of heat exchangers typically involves etching or scoring panes of glass, which are then bonded together to form heat exchange elements. Among other things, the bonding process, or the presence of the bond between the glass layers, may reduce the effectiveness of the glass in exchanging heat with the gas flowing through the etched layers. In other cases, heat exchangers may be formed by a plurality of perforated glass plates, having slots etched in each layer, separated by spacers.

What is needed is, among other things, improvements over known heat exchanger geometries and structures, which permit a more effective heat transfer without resulting in an excessive pressure drop.

SUMMARY

According to an embodiment, a heat exchanger may comprise a glass body having a first flat face and a second flat face on opposing ends. The first flat face and the second flat face may define a longitudinal axis therebetween. The heat exchanger may further have a plurality of holes in the glass body. The holes may be elongated along the longitudinal axis by extending from said first flat face to said second flat face. The plurality of holes may be configured to receive and direct a gas therethrough to exchange heat between the gas and the glass body.

Other aspects and embodiments will become apparent from the following detailed description, the accompanying drawings, and the appended claims.

BRIEF DESCRIPTION OF THE DRAWINGS

Various features of embodiments of this disclosure are shown in the drawings, in which like reference numerals designate like elements.

DETAILED DESCRIPTION

Figure 1:
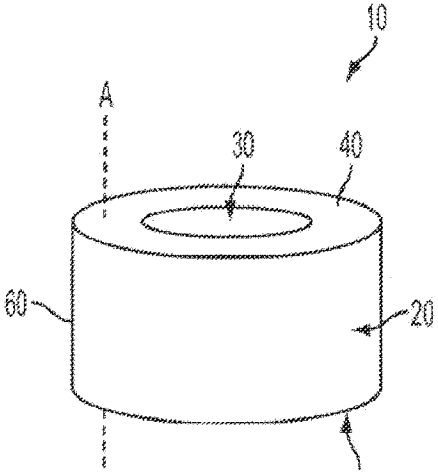
FIG. 1 shows a perspective view of an embodiment of a heat exchanger of the present disclosure, having an annular configuration.

FIG. 1 illustrates an embodiment of heat exchanger 10 of the present disclosure, configured to exchange heat with a gas flowing therethrough. Heat exchanger 10 may be configured to be utilized in any suitable application, including but not limited to a cryocooler or a heat-engine. In the illustrated embodiment, heat exchanger 10 contains glass body 20 having first flat face 40 and second flat face 50. Glass body 20 may be of any appropriate construction or configuration, and formed from any appropriate configuration of glass. In an embodiment, the glass of glass body 20 may be selected for heat transfer properties, or ease of creation, for example. In various embodiments, glass body 20 may comprise glass made from borosilicate, lead oxide, or soda-lime glass. These glass compositions are not limiting, and in other embodiments glass body 20 may comprise other formulations of glass.

Figure 10:
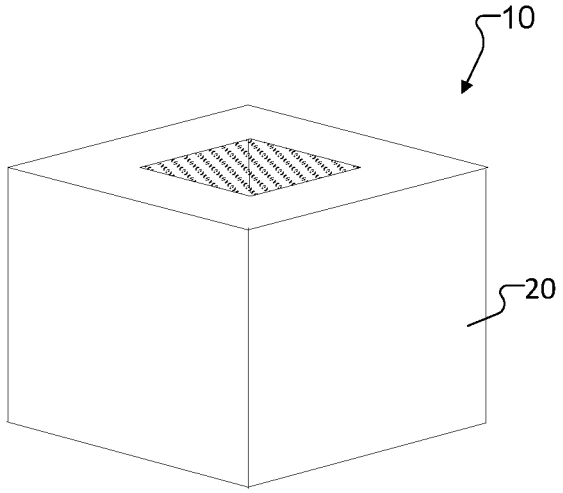
FIG. 10 shows a perspective view of an embodiment of a heat exchanger configured as a rectangular prism with multiple planar surfaces.

Glass body 20 may be of any appropriate shape. In the illustrated embodiment, glass body 20 has a generally annular cross sectional configuration around central aperture 30. In other embodiments, glass body 20 may lack central aperture 30, and may be of a circular or elliptical cross sectional configuration, such that glass body 20 approximates a cylinder. In further embodiments, glass body 20 may be of any other appropriate geometric shape, including having a triangular, rectangular, pentagon, hexagon, U shaped, or any other multi-sided cross section (forming a geometric prism or other polyhedron). For example, FIG. 10 shows an example of a glass body 20 configured as a rectangular prism having a rectangular cross section and multiple planar surfaces. In various embodiments central aperture 30 may be formed in or around these alternative shapes. Furthermore, central aperture 30 may be of any shape or configuration, including defining a space having any cross section, including those described above for glass body 20.

Central aperture 30 may be configured for any suitable purpose. For example where heat exchanger 10 is configured to be used in a cryocooler, central aperture 30 may be configured to couple with a portion of the cryocooler. In an embodiment, the cryocooler may comprise a portion extending therefrom, such as a pulse tube, which may be received by central aperture 30 to connect heat exchanger 10 into the cryocooler. In other embodiments, central aperture 30 may be configured to receive other elements. For example, in embodiments in which heat exchanger 10 is being used in a heat engine, central aperture 30 may be configured to receive a moving piston for the heat engine.

First flat face 40 and second flat face 50 are spaced on opposing ends of glass body 20. In the illustrated embodiment, first flat face 40 and second flat face 50 are configured in approximately parallel planes. As shown, first flat face 40 and second flat face 50 are depicted as equivalent to any given cross section of glass body 20, because of this uniformity. In other embodiments, first flat face 40 and second flat face 50 may be intentionally angled with respect to one another, or with respect to other portions of glass body 20. FIG. 1 also shows longitudinal axis A defined by a line intersecting first flat face 40 and second flat face 50 approximately along a direction of elongation of glass body 20. In an embodiment, the direction of elongation may be characterized by the direction of exterior sides 60 (and interior sides 65, shown in FIG. 2A, if aperture 30 is present) of glass body 20, connecting first flat face 40 to second flat face 50.

Figure 2A:
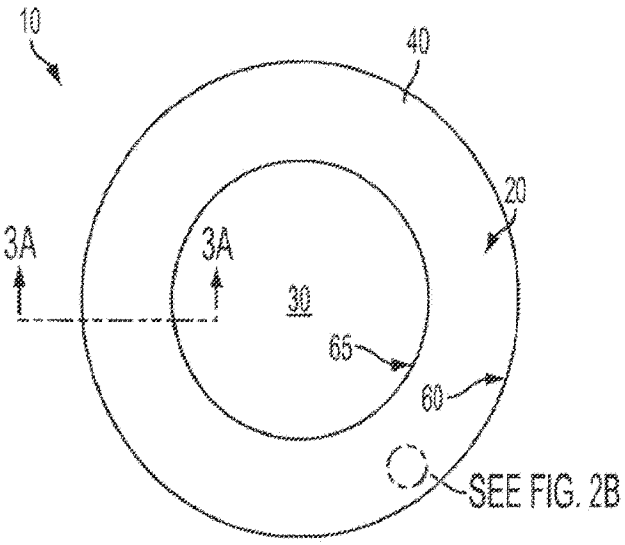
FIG. 2A shows a top view of the embodiment of FIG. 1, illustrating in an enlargement in FIG. 2B that the heat exchanger contains a plurality of holes therein.
Figure 2B:
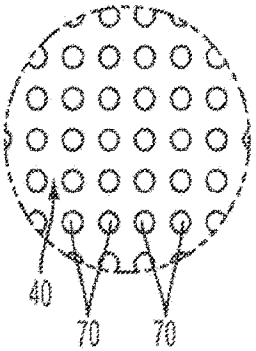

FIG. 2A shows a top view of glass body 20, in particular looking at first flat face 40 along longitudinal axis A. As seen in the area of enlargement highlighted in FIG. 2B, glass body 20 is not solid, however contains a plurality of holes 70 formed in the glass. Holes 70 may be of any cross sectional shape, including but not limited to circular (or elliptical), rectangular, pentagon, hexagon, U-shape or any other geometric shape. Additionally, holes 70 may be of any appropriate size, including but not limited to having a size on the order of 5-100 μm across a side on first flat face 40 and/or second flat face 50. The spacing between holes 70 may also be of any appropriate size, including but not limited to being on the order of 10-20 μm across between adjacent holes 70. The size, number, and spacing of holes 70 in glass body 20 all affect the porosity of glass body 20, which in turn affects rate of heat transfer between the gas and glass body 20.

Figure 3A:
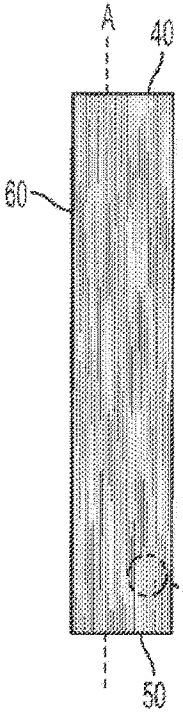
FIG. 3A shows a cross sectional view of a portion of the embodiment of FIG. 1, showing in an enlargement in FIG. 3B that the holes of FIGS. 2A-B extend along the length of the heat exchanger.
Figure 3B:
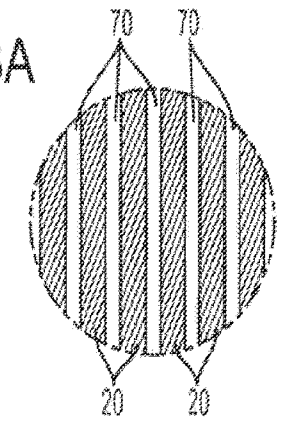

FIG. 3A illustrates a cross section of glass body 20 along section line III (seen in FIG. 2A). As seen in the enlargement of FIG. 3B, holes 70 extend through glass body 20 from first flat face 40 to second flat face 50. Also as shown, the holes are all roughly parallel to each other, spaced from longitudinal axis A. The length of the holes 70 extending through glass body 20 also contribute to the porosity of glass body 20. In an embodiment, the porosity of glass body 20 may comprise the ratio of the volume of holes 70, as compared to the total volume of glass body 20 which includes the volume of holes 70. The volume of glass body 20 excludes the volume of central aperture 30, if present. In various embodiments, the porosity of glass body 20 may be less than 60%, including in some embodiments, a porosity of less than 45%. Such reduced porosity may result in glass body 20 having a higher heat capacity, due to the increased solid volume in glass body 20. Such higher heat capacity may be useful in low temperature applications, because the specific heat of materials in heat exchanger 10, such as glass bodies 20, decreases at low temperatures, and can be made up for by increasing the solid volume (by lowering the porosity). In some embodiments, variation in the cross sectional size of holes 70 through glass body 20 may vary by less than 2% along the length of holes 70 extending through glass body 20. In various embodiments, the length of side 60 and holes 70 therein may range from approximately 75 μm to 350 mm. The choice of porosity for glass body 20 affects, among other things, the pressure drop between first flat face 40 and second flat face 50, and may be optimized based on factors such as the flow rate and pressure of a gas flowing through holes 70.

The formation of glass bodies 20 with holes 70 may be by any suitable process. In an embodiment, holes 70 may be formed from drawn-glass flow tubes. In some embodiments, holes 70 may be etched from glass body 20 by exposure to a chemical rinse. In an embodiment, fibers of etchable core glass surrounded by non etchable cladding glass are stacked into hexagonal close-pack multifiber, which may be drawn to fuse the fibers together. In an embodiment, the hexagonal close-pack multifibers may then be stacked into a large array, and fused under pressure, which may reduce or eliminate interstitial voids. In an embodiment, the etchable core glass of each individual fiber may support the channels. In an embodiment, the fused body may be cut and ground into a blank for glass body 20, from which glass bodies 20 may be cut. In an embodiment glass body 20 may be subsequently placed in an etching solution to remove the soluble components, leaving voids that are holes 70.

As noted above, the plurality of holes 70 may be configured to receive and direct a gas therethrough, so as to exchange heat between the gas and glass body 20. In essence, glass body 20 of heat exchanger 10 may act as a gas-solid heat exchanger. In various embodiments, the size, shape, and number of holes 70 in glass body 20 may be selected to tune the porosity of glass body 20, to affect the flow of gas through heat exchanger 10. For example, holes 70 may be sized and shaped to optimize surface area against which the gas may contact to transfer heat to glass body 20. As the gas flows along the plurality of holes 70 from first flat face 40 to second flat face 50, or vice versa, hot gas may transfer that heat to glass body 20, while cool gas may receive heat from glass body 20. Additionally, having a straight channel from first flat face 40 to second flat face 50 may reduce collisions of gas molecules, resulting in a reduced pressure drop between first flat face 40 and second flat face 50. In an embodiment, the size of holes 70 across first flat face 40 and/or second flat face 50 may be selected based on the amount of gas flowing through heat exchanger 10. In an embodiment, a higher capacity system may have a greater mass of gas flowing therethrough, so a larger width of holes 70 may reduce the gas velocity. In an embodiment, the width of holes 70 may be optimized based on the operating point, type, and/or cooling capacity of the system containing heat exchanger 10.

The material selection for glass body 20 may ensure thermal isolation between portions of glass body 20 closer to first flat face 40 and portions of glass body 20 closer to flat face 40. In an embodiment, each glass body 20 may be configured to thermally isolate first flat face 40 and second flat face 50 at a temperature differential of approximately 10-50K. In other embodiments, wherein glass body 20 is longer, a greater temperature differential may be achieved. In an embodiment, each of plurality of holes 70 of glass body 20 may be substantially the same size across first flat face 40 and/or second flat face 50, so as to increase consistency of gas flow through glass body 20, thus reducing or preventing differential or preferential flow. As noted above, in an embodiment, heat exchanger 10 may be assembled into a system, such as a cryocooler or a heat engine. In such embodiments, flat face 40 and second flat face 50 of heat exchanger 10 may be aligned along the flow path of a gas that flows through heat exchanger 10 that is used in the system.

Figure 5:
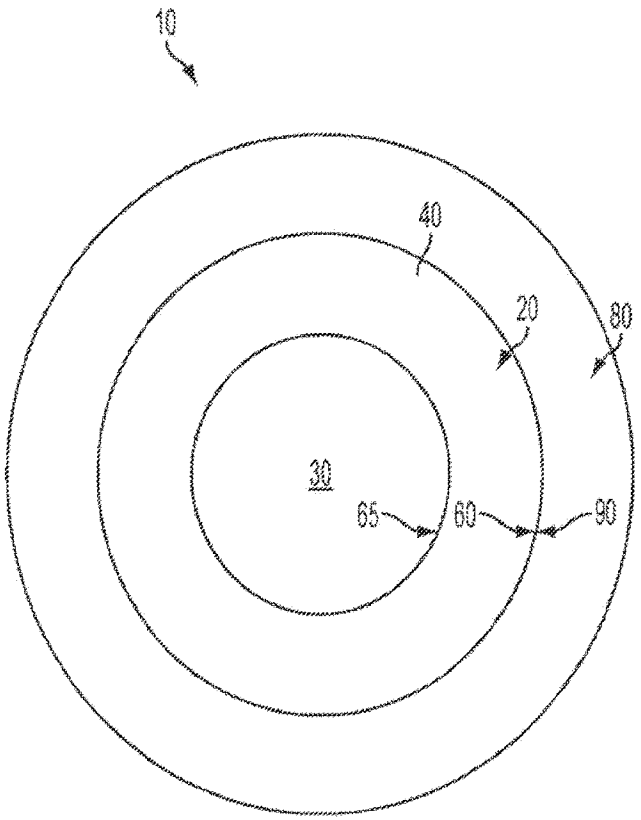
FIG. 5 shows a top view of the embodiment of FIG. 4, illustrating how the heat exchanger is isolated along an outer edge.
Figure 4:
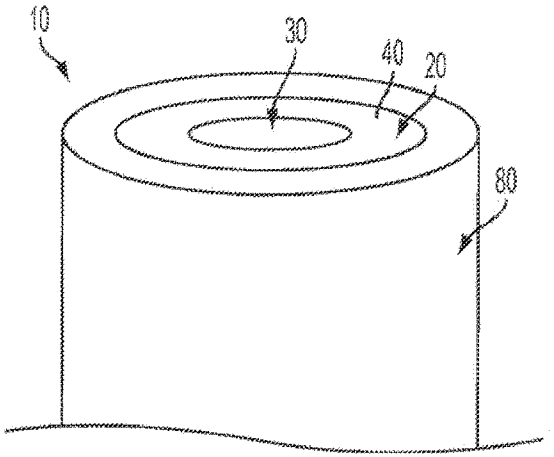
FIG. 4 shows a perspective view of an embodiment of a heat exchanger contained within a housing.

In some embodiments of heat exchanger 10, such as those shown in the perspective and top views of FIGS. 4 and 5, glass body 20 may be at least partially contained within exterior housing 80. Exterior housing 80 may be of any construction or configuration, including but not limited to metal, plastic, non-porous glass, rubber, or any other material. In an embodiment, exterior housing 80 may comprise a sleeve for glass body 20. In an embodiment, exterior housing 80 may be of sufficient thickness to withstand the pressure of gas flowing through glass body 20. In an embodiment, exterior housing 80 may comprise or contribute to the formation of a pressure vessel around glass body 20. In an embodiment, exterior housing 80 may be configured to surround exterior sides 60 of glass body 20, so as to limit exposure to glass body 20 to first flat face 40 and second flat face 50.

In an embodiment, glass body 20 may have portions of holes 70 surrounding exterior sides 60. Such portions of holes 70 may result from cutting and/or shaping glass body 70 from glass that already has holes 70 formed therein. In an embodiment, exterior housing 80 may permit gas to flow between the exterior sides 60 of glass body 20 and interior sides 90 of exterior housing 80, in particular through partially formed holes 70. As noted above, however, having same sized holes 70 is preferred in glass body 20 to prevent differential flow, so partially formed holes 70 at the exterior sides 60 of glass body 20 may be undesired. In an embodiment, an area around first flat face 40 and/or second flat face 50 of glass body 20 may be covered by caps to prevent gas flow through partially formed holes 70. In an embodiment, glass body 20 may be secured into exterior housing 80 so as to seal partially formed holes 70. In an embodiment, glass body 20 may be secured by glue or epoxy into exterior housing 80, which may fill in partially formed holes 70.

Figure 6:
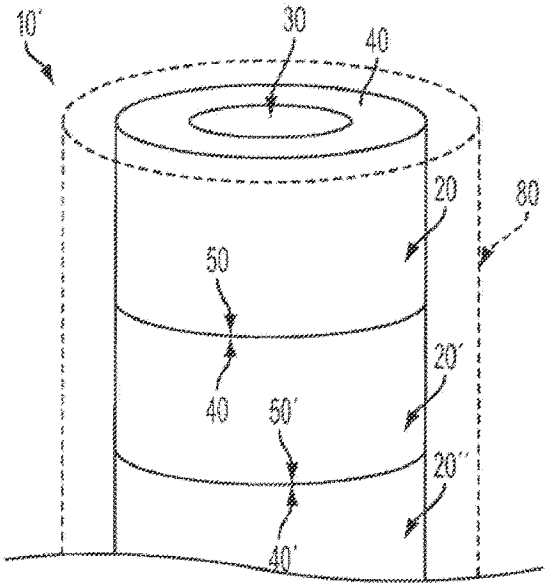
FIG. 6 shows a cutaway view of an embodiment similar to that of FIG. 4, showing a plurality of heat exchangers stacked within the housing.

In an alternative embodiment shown in FIG. 6, a cutaway view of heat exchanger 10' is depicted with exterior housing 80 shown in outline form. As illustrated, a plurality of glass bodies 20, 20', and 20" (collectively 20) are assembled within exterior housing 80. Also as shown, glass bodies 20 are assembled such that first flat face 40 or second flat face 50 for adjacent glass bodies 20 are arranged face to face within exterior housing 80. In an embodiment having n glass bodies 20, the plurality of glass bodies 20 in heat exchanger 10' may be configured such that the first flat face 40 of a first glass body 20 in heat exchanger 10' and the second flat face 50*n* of a last glass body 20*n* in heat exchanger 10 are thermally isolated with a temperature differential of approximately 80-270K. In other embodiments, such as where each glass body 20 is longer, or more glass bodies 20 are stacked together, the temperature delta may be greater. In other embodiments, such as where each glass body 20 is shorter, or fewer glass bodies 20 are stacked together, the temperature delta may be less.

In an embodiment, exterior housing 80 may be configured such that gas flowing through each of glass bodies 20 does not leak out between adjacent glass bodies 20. In some embodiments, stacks of glass bodies 20 may be utilized to overcome limits in formation of holes 70 in each glass body 20. For example, in some embodiments in which holes 70 are etched into each glass body 20 by a chemical bath, the etchant may be unable to traverse glass body 20 if glass body 20 is greater than a certain length. In some cases, holes 70 may then not be consistently etched from first flat face 40 to second flat face 50, leaving holes 70 that are partially or completely blocked off within glass body 20.

In some embodiments, holes 70 in adjacent glass bodies 20 may be aligned such that gas flowing through hole 70 in a first one of glass bodies 20 may substantially or completely enter an associated hole 70' in a second one of glass bodies 20'. Such alignment may be accomplished by any suitable mechanism, including but not limited to laser-based alignment. Due to variability in manufacturing of glass bodies 20, however, such alignment may be difficult, or unnecessary. In some embodiments, holes 70 in one glass body 20 may generally at least partially overlap two or more associated holes 70' of an adjacent glass body 20', such that, for example, gas traverses through the first hole 70, before splitting into two or more holes 70' of the adjacent glass body 20'. In an embodiment, holes 70 may be configured such that random orientation of glass bodies 20 may permit sufficient movement of gas between adjacent glass bodies 20 with minimal pressure drop. For example, in an embodiment, the arrangement of holes 70 in a glass body 20 may be such that the size of the holes 70 are larger than the connecting portions of glass body 20, permitting ease of gas flow transitions between glass bodies 20. As the number of transitions in the heat exchanger 10' is smaller than those between the stacked metal screens of conventional heat exchangers, friction from gas flow may still be reduced as compared to conventional exchangers by this improved configuration.

Figure 7:
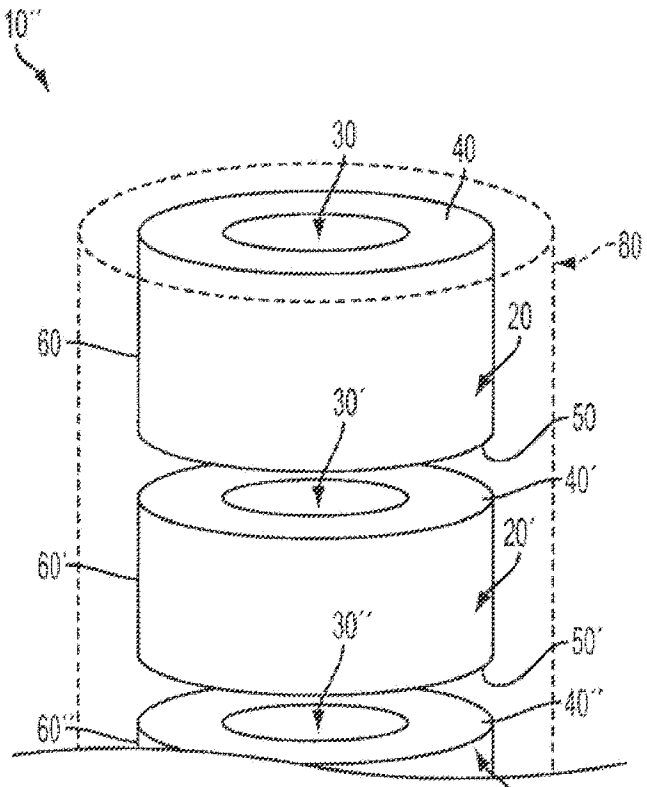
FIG. 7 shows a cutaway view of an alternative embodiment to that of FIG. 4, wherein the heat exchangers are spaced within the housing.
Figure 11A:
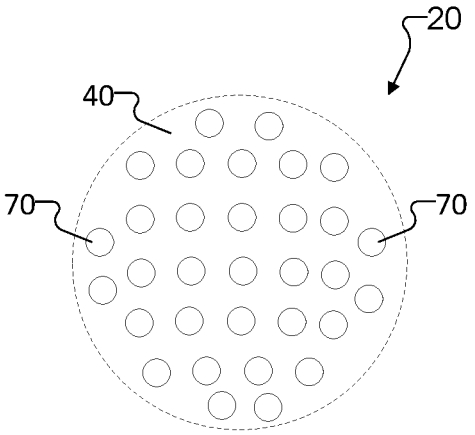
FIGS. 11A and 11B show an enlargement of portions of glass bodies having holes of different sizes.
Figure 11B:
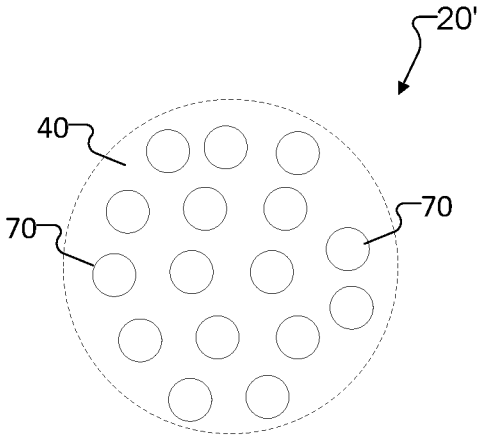

In FIG. 7, another embodiment is shown as heat exchanger 10", wherein each of the plurality of glass bodies 20 are spaced from one another in the external housing 80. In an embodiment, such a spacing may be desirable to permit the gas flowing through glass bodies 20 to redistribute after passing through each glass body 20. In an embodiment, the size of plurality of holes 70 may vary across different glass bodies 20. For example, the plurality of holes 70 in one glass body 20 may be smaller across associated flat faces 40 and 50 of that glass body 20 as compared to the plurality of holes 70' in another glass body 20' across associated flat faces 40' and 50' of the other glass body 20'. FIGS. 11A and 11B show an example of this. FIGS. 11A and 11B show an enlargement of portions of glass bodies, similar to the enlarged view of FIG. 2B. As shown in FIGS. 11A and 11B, one glass body 20 includes a plurality of holes 70 that are smaller than holes 70' in another glass body 20'. In an embodiment, the porosity of glass body 20 associated with a hot end of heat exchanger 10 may be larger than the porosity of glass body 20 associated with a cold end of heat exchanger 10. In an embodiment, each glass body 20 may be held in spaced relation in external housing 80 by being epoxied or otherwise held by the exterior sides 60 of each glass body 20.

Figure 8:
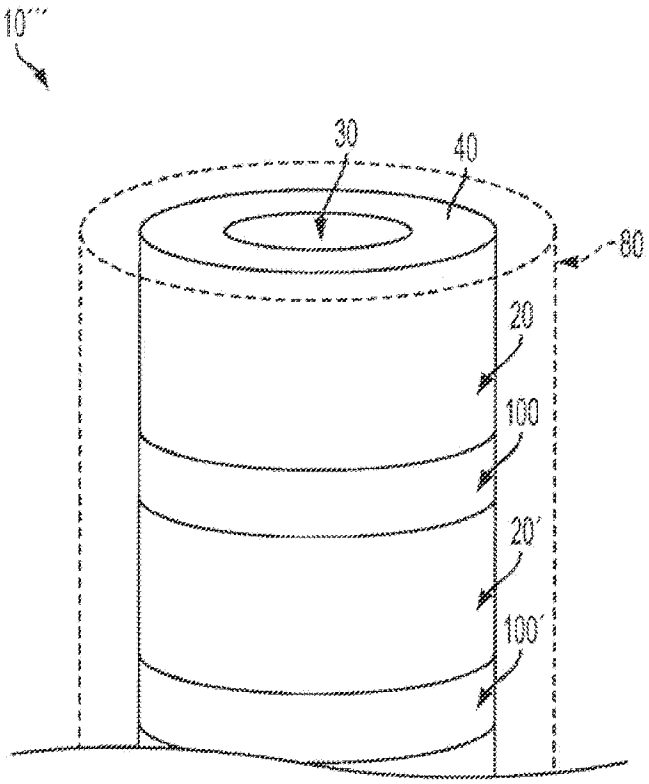
FIG. 8 shows an alternative cutaway view to that of FIG. 7, wherein the spaced heat exchangers are separated by spacers within the housing.

FIG. 8 illustrates another embodiment as heat exchanger 10''', wherein spacers 100 are positioned between glass bodies 20 to separate glass bodies 20 within exterior housing 80. In various embodiments, spacers 100 may be any suitable material, including but not limited to metal, glass, plastic, rubber or so on. In an embodiment, spacers 100 may be configured to receive and transmit the gas flowing through glass bodies 20. In an embodiment, spacers 100 may comprise sufficient openings for gas from a previous glass body 20 to redistribute before entering a subsequent glass body 20'. In an embodiment, spacers 100 may be positioned at the exterior sides of each glass body 20. In an embodiment, spacers 100 may cap partially formed holes 70 located where exterior sides 60 meet interior sides 90 of exterior housing 80.

As noted above, heat exchanger 10 may be utilized in any number of applications, including but not limited to a cryocooler or a heat-engine. The direction of flow for the gas through heat exchanger 10 may change depending on the specific application. For example, some cryocoolers may make use of a liner closed-cycle configuration, such as the Stirling cycle in which gas oscillates back and forth through heat exchanger 10. As another example, some heat engines utilize the Stirling cycle, heating the gas on one side of heat exchanger 10 and cooling the gas on the other, such that movement from the expansion and contraction of gas therethrough generates electrical or mechanical energy which may be harnessed.

In embodiments wherein the working gas oscillates through heat exchanger 10, heat exchanger 10 may be characterized as a regenerator. In an embodiment, this oscillation may be at a rate of approximately 20-100 Hz. In an embodiment, as gas flows from a hot end of the cryocooler through heat exchanger 10 to a cold end of the cryocooler, the gas may give up heat to glass bodies 20 in heat exchanger 10. As the flow reverses to flow from the cold end to the hot end, the gas may absorb heat back from glass bodies 20. Because of this cyclic pattern, the net energy gain in heat exchanger 10 over any cycle when in this configuration may be approximately zero.

In other embodiments, the working gas may be configured to flow in one direction through glass bodies 20 of heat exchanger 10. In such steady flow embodiments, which may operate by any number of mechanisms, including but not limited to the Joule-Thompson effect. As an example, gas may flow through heat exchanger 10, and be cooled as it flows through holes 70 of glass bodies 20, which act as the valve for the throttling process. In other embodiments, the length of glass bodies 20 may merely be configured to act as a solid-gas heat exchanger, such that as the gas flows through holes 70, heat transfers to glass bodies 20, and radiates outward from glass bodies 20 to the ambient environment. In an embodiment heat exchanger 10 configured to operate in a steady-flow embodiment may be characterized as a recuperator.

Regardless of the presence of a reversal of the direction of gas flow, in various embodiments as the gas flows axially through the plurality of holes 70, the gas may cool from first flat face 40 to second flat face 50. In an embodiment, the number of glass bodies 20 in heat exchanger 10 may be selected based on the amount of cooling and thermal separation required between the hot end and the cold end of heat exchanger 10. In an embodiment, a set of approximately 5 to 10 of glass bodies 20 may be assembled into heat exchanger 10. In an embodiment, heat exchanger 10 may be configured to thermally isolate the hot end and the cold end to prevent the parasitic conduction of heat from the hot end to the cold end. In an embodiment, the temperature differential between the hot end and the cold end of heat exchanger 10 may be approximately 200K. For example, the temperature may be approximately 100K at the cold end of heat exchanger 10 and approximately 300K at the hot end of heat exchanger 10, to achieve cryogenic cooling in an approximately room temperature environment. In some embodiments, such as where the system utilizing heat exchanger 10 operates in cryogenic temperatures, the cold end of heat exchanger 10 may be any cryogenic temperature (i.e. typically below 125K). In an embodiment, to achieve low cryogenic temperatures, glass bodies 20 may be configured to have a lower porosity (such as by tuning the size and number of holes 70) to achieve a lower pressure drop.

Figure 9:
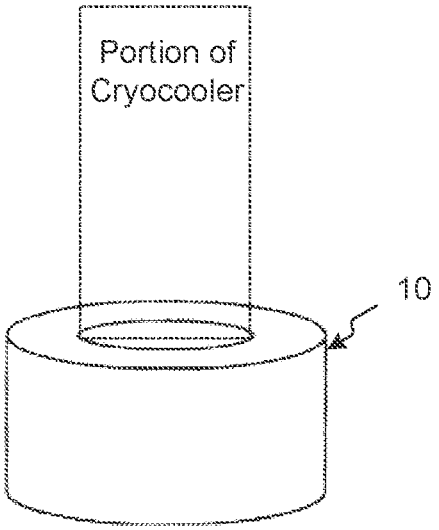
FIG. 9 shows the heat exchanger configured to receive at least a portion of a cryogenic cooler.

FIG. 9 shows the heat exchanger 10 configured to receive at least a portion of a cryogenic cooler.

While certain embodiments have been shown and described, it is evident that variations and modifications are possible that are within the spirit and scope of the inventive concepts as represented by the following claims. The disclosed embodiments have been provided solely to illustrate the principles of the inventive concepts and should not be considered limiting in any way.

What is claimed is:

1. A system comprising:
a cryogenic cooler; and
a glass body having a first face and a second face on opposing ends and defining a longitudinal axis between the opposing ends, the glass body including:
multiple planar exterior surfaces, each extending continuously from the first face to the second face;
an interior surface surrounding a single aperture, the aperture extending longitudinally from the first face to the second face; and
a plurality of holes surrounding the aperture, the plurality of holes disposed within the glass body and extending longitudinally from the first face to the second face;
wherein the holes are configured to receive and direct a gas from the cryogenic cooler through the holes to exchange heat between the gas and the glass body.

2. The system of claim 1, wherein:
the glass body comprises a first glass body; and
the system further comprises at least one additional glass body.

3. The system of claim 2, wherein:
each glass body has a porosity defined as a ratio of a total volume of the holes in the glass body to a volume of the glass body including the total volume of the holes; and
different glass bodies among the first glass body and the at least one additional glass body have different porosities.

4. The system of claim 2, wherein:
each of the holes across the first and second faces of the first glass body has a first cross-sectional area; and
each of the holes across the first and second faces of the at least one additional glass body has a cross-sectional area different from the first cross-sectional area.

5. The system of claim 1, wherein every hole across at least one of the first face and the second face has substantially the same cross-sectional area as every other hole in the at least one of the first face and the second face.

6. The system of claim 1, wherein:
the system further comprises a housing; and
the glass body is at least partially contained within the housing.

7. The system of claim 6, wherein the housing comprises one of:
a sleeve for the glass body; and
a pressure vessel around the glass body.

8. The system of claim 1, wherein each hole has an opening of 5 μm to 100 μm across at least one of the first face or the second face.

9. The system of claim 1, wherein the holes extend straight from the first face to the second face.

10. The system of claim 1, wherein the multiple planar exterior surfaces define a rectangular prism.

11. The system of claim 1, wherein the first and second faces are flat.

12. A system comprising:
a cryogenic cooler; and
a heat exchanger comprising a glass body having a first face and a second face on opposing ends and defining a longitudinal axis between the opposing ends, the glass body including:
multiple planar exterior surfaces, each extending continuously from the first face to the second face;
an interior surface surrounding a single aperture, the aperture extending longitudinally from the first face to the second face; and a plurality of holes surrounding the aperture, the plurality of holes disposed within the glass body and extending longitudinally from the first face to the second face;

wherein at least a portion of the aperture that is adjacent the first face is configured to receive at least a portion of the cryogenic cooler;

wherein the holes are configured to receive and direct a gas through the holes to exchange heat between the gas and the glass body; and wherein the system is configured so that the gas flows between a hot end of the system and a cold end of the system through the plurality of holes in the glass body.

13. The system of claim 12, wherein the aperture includes an opening on the first face, the opening configured to receive at least the portion of the cryogenic cooler.

14. The system of claim 12, wherein:

the glass body comprises a first glass body; and the heat exchanger further comprises at least one additional glass body.

15. The heat exchanger system of claim 14, wherein:

each glass body has a porosity defined as a ratio of a total volume of the holes in the glass body to a volume of the glass body including the total volume of the holes; and different glass bodies among the first glass body and the at least one additional glass body have different porosities such that the porosity of a glass body associated with the hot end of the heat exchanger is larger than the porosity of a glass body associated with the cold end of the heat exchanger.

16. The system of claim 14, wherein:

each of the holes across the first and second faces of the first glass body has a first cross-sectional area; and each of the holes across the first and second faces of the at least one additional glass body has a cross-sectional area different from the first cross-sectional area.

17. The system of claim 12, wherein the holes extend straight from the first face to the second face.

18. The system of claim 12, wherein the multiple planar exterior surfaces define a rectangular prism.

19. The system of claim 12, wherein the first and second faces are flat.

20. A system comprising:

a cryogenic cooler; and a heat exchanger comprising a glass body having a first face and a second face on opposing ends and defining a longitudinal axis between the opposing ends, the glass body including:

multiple planar exterior surfaces, each extending continuously from the first face to the second face;

an interior surface surrounding a single aperture, the aperture extending longitudinally from the first face to the second face; and a plurality of holes surrounding the aperture, the plurality of holes disposed within the glass body and extending longitudinally from the first face to the second face, wherein the holes extend straight from the first face to the second face;

wherein the aperture includes an opening on the first face, the opening configured to receive at least a portion of the cryogenic cooler;

wherein the holes are configured to receive and direct a gas through the holes to exchange heat between the gas and the glass body; and wherein the heat exchanger is configured so that the gas flows between a hot end of the heat exchanger and a cold end of the heat exchanger through the plurality of holes in the heat exchanger.

* * * * *